United States Patent [19]

Phelps et al.

[11] Patent Number: 4,903,827

[45] Date of Patent: Feb. 27, 1990

[54] SUSPENDED LOAD CONTAINER

[75] Inventors: Randall J. Phelps, Watertown; Thomas W. Thomsen, Marion, both of Wis.

[73] Assignee: Menasha Corporation, Neenah, Wis.

[21] Appl. No.: 337,027

[22] Filed: Apr. 12, 1989

[51] Int. Cl.[4] ..... B65D 81/10; B65D 85/30

[52] U.S. Cl. ..... 206/204; 206/472; 206/528; 206/583

[58] Field of Search ..... 206/594, 591, 589, 588, 206/583, 521, 528, 204, 472; 220/339

[56] References Cited

U.S. PATENT DOCUMENTS

| | | | |
|---|---|---|---|
| 1,848,849 | 3/1932 | Stone . | |
| 2,681,142 | 6/1954 | Cohen . | |
| 3,181,693 | 5/1965 | Freistat . | |
| 3,708,946 | 1/1973 | Cahill . | |
| 3,853,220 | 12/1974 | Luray | 206/583 |
| 4,294,558 | 10/1981 | Errichiello | 220/339 |
| 4,491,225 | 1/1985 | Baillod | 206/583 |
| 4,585,121 | 4/1986 | Capelle, Jr. | 206/583 |
| 4,620,633 | 11/1986 | Lookholder | 206/523 |
| 4,679,688 | 7/1987 | Soderhold et al. | 206/204 |

FOREIGN PATENT DOCUMENTS

| | | | |
|---|---|---|---|
| 2583389 | 12/1986 | France | 206/528 |

*Primary Examiner*—Jimmy G. Foster
*Assistant Examiner*—Jacob K. Ackun, Jr.
*Attorney, Agent, or Firm*—Quarles & Brady

[57] ABSTRACT

A container for packaging fragile articles such as vials in a suspended state between two flexible membranes. An absorbent material is placed in compartments for the vials and is in fluid communication with the vials in case of breakage and spillage of fluid therefrom. In a preferred embodiment, the absorbent material extends upwardly along a compartment wall so as to be in close communication with one of the membranes. This affords a faster wicking action even if spillage should occur when the container is upside-down.

12 Claims, 3 Drawing Sheets

FIG. 5
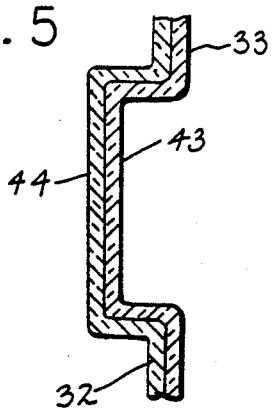
FIG. 7
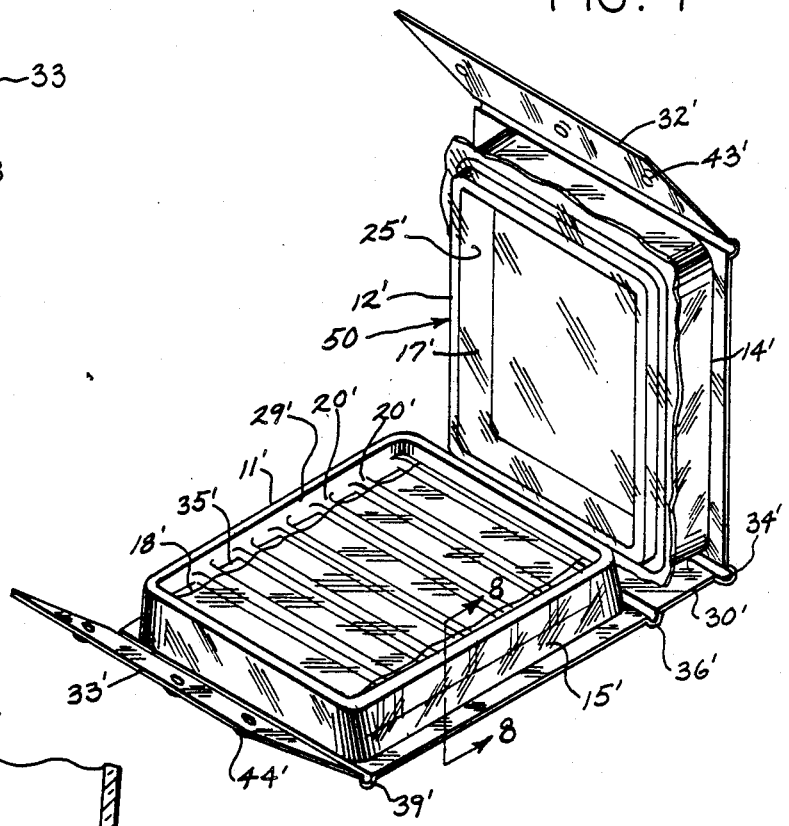
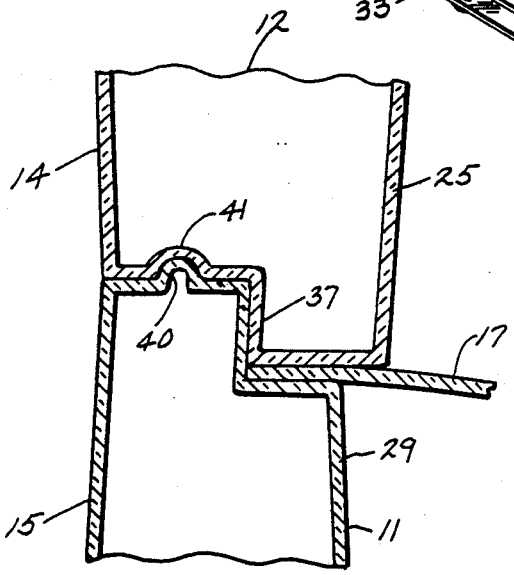
FIG. 6
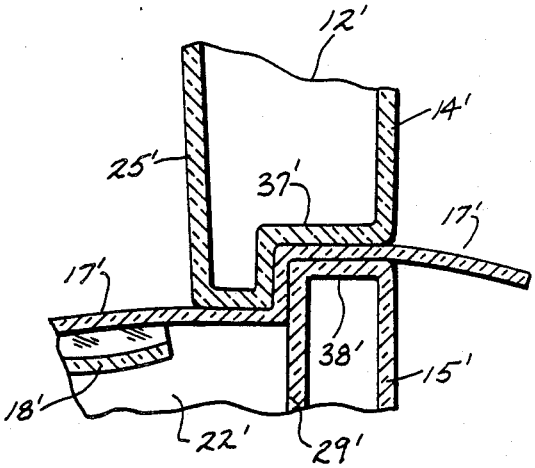
FIG. 8

SUSPENDED LOAD CONTAINER

BACKGROUND OF THE INVENTION

This invention relates to a container for shipping fragile articles such as plastic or glass vials. More particularly, it relates to a container for packaging one or more smaller containers, wherein the smaller containers are held in a suspended state.

It is known in the prior art to position fragile articles between two membranes in a package. This is described in U.S. Pat. No. 4,491,225 as well as U.S. Pat. No. 2,681,142. It is also known to package fragile articles between cellular material. This is shown in U.S. Pat. No. 4,620,633. The prior art also shows that it is known to utilize a sponge material in a package. This is illustrated in U.S. Pat. No. 1,848,894.

However, in the instance where it is desired to package and ship materials in fragile containers, such as vials containing fluids as represented by body fluids such as blood, urine or the like, it is necessary that the container not only suspend the vial in the container but also have fluid channels as well as an absorbent material. This provides passage of the escaped fluid to the absorbent material to absorb the fluid in case of breakage.

SUMMARY OF THE INVENTION

This invention provides an improved container for at least one fragile article wherein a tray portion and a cover portion each include an upwardly extending and continuous peripheral wall encompassing cavity portions. The peripheral wall of the tray and the cover portion are constructed and arranged to present the cavity portions in a face-to-face relationship. Partitions extend between opposing sides of the tray to provide in part open compartments for an absorbent material. A first flexible membrane is disposed between the partitions in a hammock like manner to support the fragile article. There is also a second flexible membrane disposed over the cavity portion in the cover. The flexible membranes provide a fluid dampening effect for the article placed on the first flexible membrane disposed between the partitions when said tray portion and said cover portions are engaged. The first flexible member is spaced from the tray walls to provide a fluid passage to the absorbent material.

In one embodiment, the second flexible membrane is also disposed over the peripheral wall in the cover portion.

In another embodiment, the peripheral wall of the tray and cover portions have flanges which interfit in a tongue and groove manner.

In a preferred embodiment, the absorbent material has end portions extending along the tray walls.

It is an advantage of this invention to provide a container for fragile articles such as vials or the like, wherein the container not only provides for a suspension of the vials in the container, but also includes means for absorbing any spilled fluids from the vials.

It is another advantage of this invention to provide a container of the foregoing type wherein spillage of the contents can be readily absorbed in the container whether the container is in an upright or upside-down condition.

Still another advantage of this invention is to provide a container of the foregoing type, wherein one or more vials can be accommodated in a single container.

Yet another advantage of this invention is to provide a container of the foregoing type wherein the contents of the container are readily observed.

Other advantages include a container of the foregoing type which can be easily manufactured at low cost while providing a container which is durable.

The foregoing and other advantages will be apparent from the description to follow.

BRIEF DESCRIPTION OF THE DRAWINGS

FIG. 5 is a view in vertical section taken along line 5—5 of FIG. 1.

FIG. 6 is a view in vertical section taken along line 6—6 of FIG. 1.

FIG. 7 is a view similar to FIG. 2 showing an alternative embodiment.

FIG. 8 is a view in vertical section taken along line 8—8 of FIG. 7.

DESCRIPTION OF THE EMBODIMENTS

Figure 1:
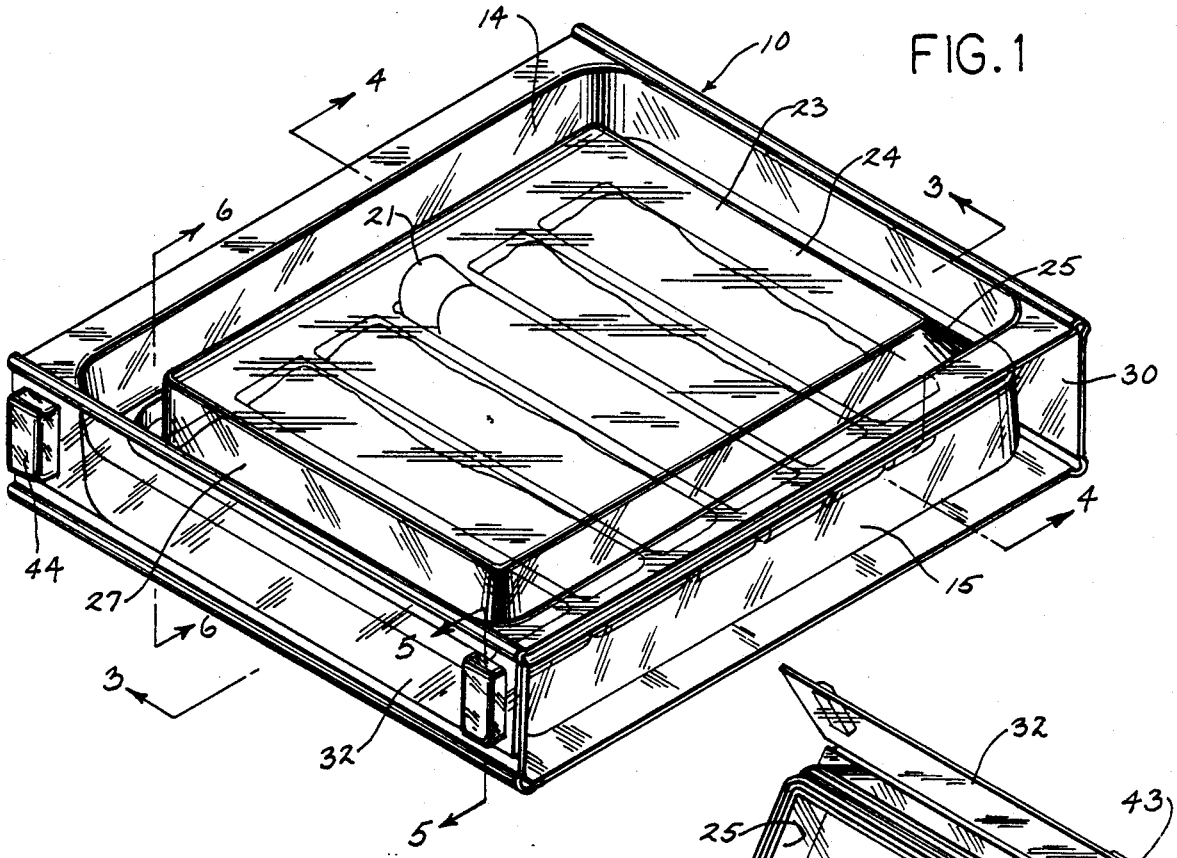
FIG. 1 is a top perspective view of the container of this invention showing a preferred embodiment.
Figure 2:
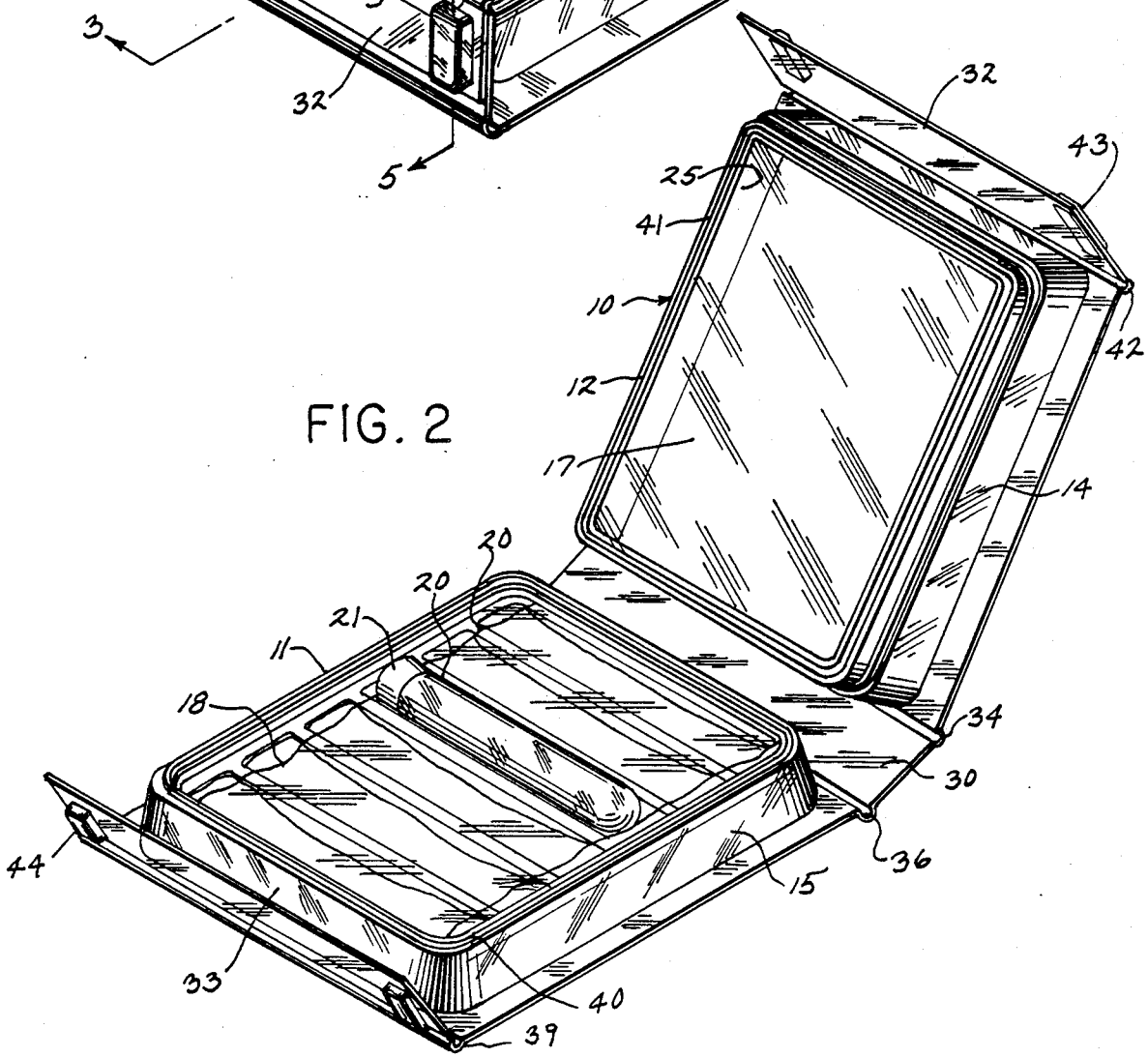
FIG. 2 is a top perspective view of the container of FIG. 1 shown in an opened position.

A preferred embodiment of the container of this invention is shown generally at 10. As best seen FIGS. 1 and 2, it includes a tray portion 11 and a cover portion 12. A peripheral wall 14 extends from the cover portion and provides a support for a one piece membrane 17. A complementary peripheral wall 15 extends from the tray portion 11 and in conjunction with peripheral wall 14 provides an enclosure for a vial such as shown at 21. As best seen in FIG. 2, the tray portion 11 has partition walls 20 over which is draped and secured the membrane 18 as one continuous piece of material.

Figure 3:
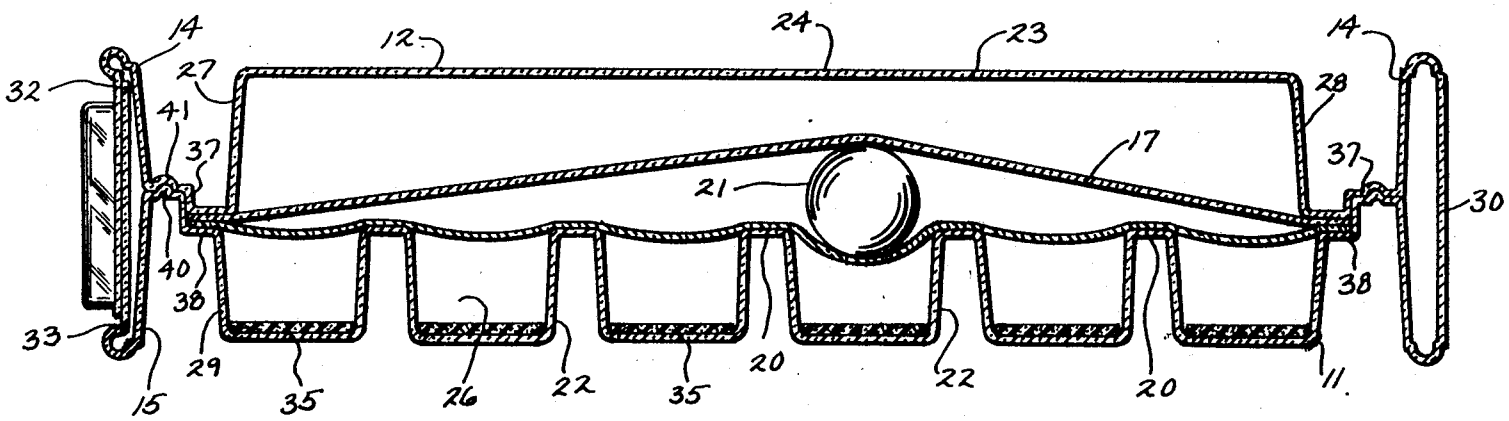
FIG. 3 is a view in vertical section taken along line 3—3 of FIG. 1.

Referring specifically to FIG. 3, it is seen that the partition walls 20, in conjunction with the tray walls 22, form compartments 26 for strips of the absorbent material 35 which preferably is a foamed polyurethane plastic material. Preferably, it has the capacity to absorb the entire contents of the vial 21. When the vial 21 is placed over the membrane 18, and the cover portion 12 is in a closed position, the membrane 17 will be pushed up into the cover compartment 23, formed by the top wall 24, the side walls 25 (see FIGS. 1 and 2), and the front and rear walls 27 and 28, respectively.

Figure 4:
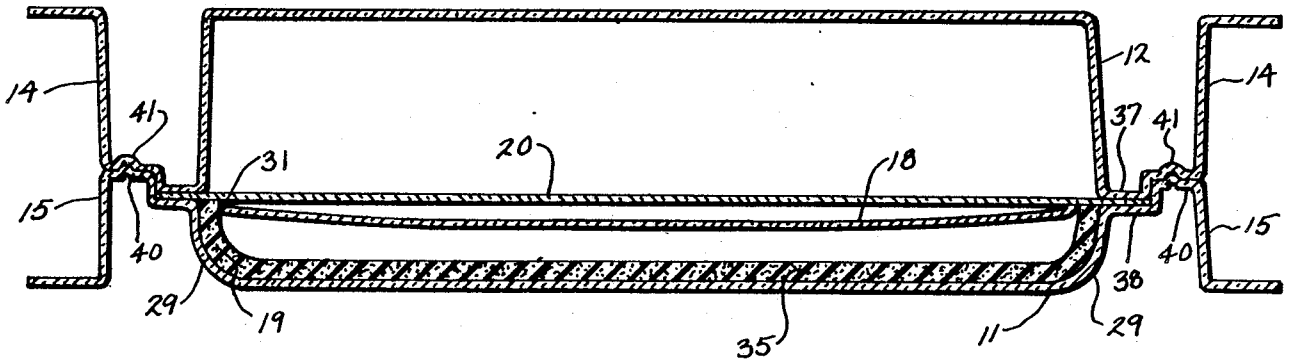
FIG. 4 is a view in vertical section taken along line 4—4 of FIG. 1.

As best seen in FIG. 4, the membrane 18 is spaced from the end tray walls 29 to afford a passage 31. It will be seen that the absorbent material 35 is bent upwardly into the passage 31 and terminates adjacent the sides of the membrane 18. The purpose of this is to afford a wicking action for the fluid in case of breakage of the vial 21. The curved portions 19 of the absorbent material in this position will absorb the spilled fluid when the container is either in an upright position as shown in FIG. 4 or in an upside-down position.

Also as best seen in FIGS. 3, 4 and 6, there is a Z-shaped flange portion 37 which extends between the peripheral wall 14 and the cover compartment 23. A complementary Z-shaped flange 38 extends between the bottom peripheral wall 15 and the outside tray wall 29. Flange 38 has a tongue 40 for fitting into a complementary groove 41 in the flange 37. This occurs when the cover portion 12 engages the tray portion 11 and is the position shown in FIGS. 3 and 4. This provides a tight interfitment between these portions, and a tight sealing of the container 10 in general.

Referring back to FIGS. 1 and 2, it will be seen that the tray portion 11 and the cover portion 12 are hingedly attached by the one-piece rear flap portion 30 having the hinge sections 34 and 36. The tray and cover portions 11 and 12 are locked together by the front flap portions 32 and 33 which are hinged such as at 39 and 42. Receiving portions 44 in the flap portion 33 frictionally engage the projecting portions 43 in the flap portion 32 to provide a closed and sealed unit as shown in FIG. 1 and in detail in FIG. 5. This also affords a temporary locking means.

Referring to the embodiment which is shown generally at 50 in FIGS. 7 and 8, it is similar to embodiment 10 and similar numbers designate similar parts except they are "primed". One of the differences between embodiment 50 and embodiment 10 is that while it has the two membranes 17' and 18', the membrane 17' is not commensurate with the peripheral wall 14' as in embodiment 10. Instead it extends beyond the wall on all four sides so as to provide a seal between the cover portion 12' and the tray portion 11'. This is best seen in FIG. 8.

As particularly indicated in FIG. 8, it will be noted that the tongue and groove arrangement as indicated at 40 and 41 in FIG. 6, is not provided for interlocking cover portion 12 and the tray portion 11. Instead only the Z-shaped flange portions 37' and 38' and membrane 17' provide the interfitment and sealing.

As illustrated in the drawings, all of the component parts of embodiment 10 and embodiment 50 are made of a transparent material. Except for the membranes 17, 17' and 18 and 18' they can be fabricated from a thermoformed PVC, high density polyethylene, polypropylene, polycarbonate or similar resinous plastics. The membranes are a clear polyurethane plastic film and are radiofrequency sealed to the walls 14 and 15. This transparency of the parts is advantageous in observing the contents of the container. It has a distinct advantage in the event the packaged article or container such as a vial has been broken, and it may contain a potentially contaminated fluid, this problem can be observed by the handler before opening. If desired, the container can be discarded without having to open it. As indicated earlier, the container offers the added advantage in this respect that if the contents are broken, the absorbent material 35 will absorb the spilled fluid. Embodiment 10 offers a still further advantage in having the curved portions 19 of the absorbent material 35 in closer proximity to the membrane 18. This provides faster wicking action even when the container is upside-down. When the container is in an upright position, the spilled fluid will tend to flow along the depressed portions of membrane 18 such as shown in contact with the vial 21 in FIG. 3. When the container is upside down, the contents of the vial will still be trapped between the membranes 17 and 18. However, the curved portions 19 of the absorbent material will still be in communication with this area.

As indicated above, container embodiment 10 has a tongue and grove arrangement 40 and 41 for interlocking the cover position 12 and the tray portion 11 whereas container embodiment 50 has the membrane 17' extending beyond the sides of the peripheral wall 14'. If desired, these two features could be combined in the same container with the membrane 17' extending between the tongue and groove arrangement 40 and 41.

It should also be pointed out, that containers 10 and 50 provide a suspended packaging system for the vials and thus protecting the contents from vibration and shock. Both embodiments also provide a fluidproof barrier when the containers are closed. They are also designed to be enclosed in an outer carton for shipping purposes.

While both embodiments show compartments for accommodating six vials, fewer vials can be accommodated with the same indicated suspension features. Obviously, both packages can be designed with only one or a multiplicity of compartments. While vials have been shown as an example of one fragile article or container for liquids, obviously other types of containers or articles could be accommodated where they must be handled in a safe manner because of their contents. The invention is, therefore, not intended to be limited to the showing or description herein, or in any other manner, except in so far as may specifically be required.

We claim:

1. A container for at least one fragile article comprising:

a tray portion and a cover portion each including an outwardly extending and continuous peripheral wall encompassing cavity portions, said peripheral wall of said tray and cover portion constructed and arranged to present the cavity portions in a face-to-face relationship;

partitions extending between opposing sides of said tray portion to define in part at least one open compartment;

an absorbent material in said compartment;

a first flexible membrane disposed between said partitions in a hammock like manner to support said fragile article; and a second flexible membrane disposed over said cavity portion in said cover portion;

said flexible membranes providing a fluid dampening effect for said fragile article placed on said first flexible membrane disposed between said partitions when said tray portion and said cover portion are engaged, and said first flexible membrane spaced from said tray walls to provide a fluid passage to said absorbent material with a major portion of said absorbent material being disposed on a side of said first flexible membrane opposite said fragile article.

2. The container as defined in claim 1 wherein said peripheral wall of said tray and cover portion include flanges which interfit in a tongue and groove manner.

3. The container as defined in claim 1 wherein there are a multiplicity of said partitions and a continuous piece of said first flexible member extends over each of said partitions to provide said support for said fragile article.

4. The container as defined in claim 1 wherein said tray and cover portions are hingedly attached by a one piece hinge portion.

5. The container as defined in claim 6 further including temporary locking means operatively associated with said tray and cover portions.

6. The container as defined in claim 1 wherein said fragile article is a vial placed between said membranes and over said compartment.

7. A unitary container for containing at least one vial or the like comprising:

a tray portion;

a cover portion connected to said tray portion by a unitary hinge section, said tray and cover portions including cavity sections for positioning in a face-to-face relationship;

at least two partition members extending between opposite walls of said tray portion;

first and second continuous sheets of flexible plastic material extending over the cavity in said cover portion and over said partition members in a draped manner but spaced from a floor of said tray portion to support a vial or the like;

said tray and cover portions constructed and arranged to provide engagement with each other;

an absorbent material in said compartment;

fluid passage means extending between said flexible sheets of material and said absorbent material; and flap members extending opposite said unitary hinge section and having interengagement means to provide a locking device.

8. The container as defined in claim 7 wherein all of the components of said package are formed from a resinous plastic material.

9. The container as defined in claim 8 wherein said absorbent material is plastic foam.

10. The container as defined in claim 7 wherein said first and second continuous sheets of flexible plastic material provide dampening effects for any vials or the like placed on the draped plastic material.

11. A container for at least one fragile article comprising:

a tray portion and a cover portion each including an outwardly extending and continuous peripheral wall encompassing cavity portions, said peripheral wall of said tray and cover portion constructed and arranged to present the cavity portions in a face-to-face relationship;

partitions extending between opposing sides of said tray portion to define in part at least one open compartment;

an absorbent material in said compartment;

a first flexible membrane disposed between said partitions in a hammock like manner to support said fragile article; and a second flexible membrane disposed over said cavity portion and said peripheral wall in said cover portion;

said flexible membranes providing a fluid dampening effect for said fragile article placed on said first flexible membrane disposed between said partitions when said tray portion and said cover portion are engaged, and said first flexible membrane spaced from said tray walls to provide a fluid passage to said absorbent material.

12. A container for at least one fragile article comprising:

a tray portion and a cover portion each including an outwardly extending and continuous peripheral wall encompassing cavity portions, said peripheral wall of said tray and cover portion constructed and arranged to present the cavity portions in a face-to-face relationship;

partitions extending between opposing sides of said tray portion to define in part at least one open compartment;

an absorbent material in said compartment;

a first flexible membrane disposed between said partitions in a hammock like manner to support said fragile article; and a second flexible membrane disposed over said cavity portion in said cover portion;

said flexible membranes providing a fluid dampening effect for said fragile article placed on the said flexible membrane disposed between said partitions when said tray portion and said cover portion are engaged, and said first flexible membrane spaced from said tray walls to provide a fluid passage to said absorbent material, said absorbent material having end portions extending along said tray walls.

* * * * *